US007520827B1

(12) United States Patent
Esposito

(10) Patent No.: US 7,520,827 B1
(45) Date of Patent: Apr. 21, 2009

(54) ELECTRONIC TABLE TENNIS

(76) Inventor: Charles Michael Esposito, 121 Hillside Ave., Hasbrouck Heights, NJ (US) 07604

( * ) Notice: Subject to any disclaimer, the term of this patent is extended or adjusted under 35 U.S.C. 154(b) by 0 days.

(21) Appl. No.: 12/132,768

(22) Filed: Jun. 4, 2008

(51) Int. Cl.
*A63B 71/04* (2006.01)
*A63B 71/06* (2006.01)

(52) U.S. Cl. ..... 473/496; 473/475

(58) Field of Classification Search ..... 473/496, 473/459, 470, 475
See application file for complete search history.

(56) References Cited

U.S. PATENT DOCUMENTS 3,117,783 A * 1/1964 Reid ..... 473/470
3,874,664 A * 4/1975 Faurot et al. ..... 473/462
4,119,838 A * 10/1978 Genuit ..... 377/5
4,491,954 A * 1/1985 Genuit ..... 377/5
5,566,936 A 10/1996 Newgarden et al.
5,733,210 A * 3/1998 Yiu ..... 473/475
6,200,236 B1 3/2001 Minami et al.
6,270,431 B1 8/2001 Martin

* cited by examiner

*Primary Examiner*—Raleigh W. Chiu
(74) *Attorney, Agent, or Firm*—Howard M. Cohn

(57) ABSTRACT

The present invention is an electronic table tennis apparatus including an electronic scoreboard, a plurality of touch sensors disposed on a table tennis table for sending sensor signals to the scoreboard. A plurality of laser scanner/locators create a locator field to identify the location of the ball and send location signals to the scoreboard. The apparatus also includes a table tennis ball having an identifying code imprinted upon its surface. The electronic scoreboard integrates the sensor signals from the touch sensors and the location signals from the laser scanner/locators for calculating and displaying the score. The electronic scoreboard can also have an alerting system to notify of score changes.

20 Claims, 2 Drawing Sheets

ELECTRONIC TABLE TENNIS

FIELD OF THE INVENTION

The present invention relates to indoor games, specifically to table tennis, also known as ping pong, and to the use of electronic sensors to monitor the location of the ball in play. More specifically the present invention relates to an electronic table tennis apparatus for scoring a table tennis game.

BACKGROUND OF THE INVENTION

Racket and paddle sports have huge numbers of recreational participants. Some of the more popular racket and paddle sports include tennis, racquetball, badminton, and ping pong.

A common problem encountered by recreational players is losing track of the score. Since there is generally no non-participating scorekeeper, the players themselves have to also track the score. This can lead to many problems, given that the player's chief focal point is on the playing of the points themselves. Although players are generally required to announce the score before each serve, confusion can be generated by long rallies, when changing servers, or simply in the course of the game itself. In addition to honest mistakes in the actual score of a game, a less than sportsmanlike player may intentionally misstate the score.

Disagreements in the score are a common cause of discord in recreational paddle and racket games, and can easily lead to arguments and decreased enjoyment of the game. In the worst case, games may be canceled because of such disagreements.

Because of the expense of having an impartial scorekeeper, that solution is rarely, if ever, available to the recreational player. Inexpensive score displays are available, but the same problems with confusion of score can arise with these manual devices. It is simply too inconvenient for a player to periodically interrupt the game to update a scoreboard. Similarly, to date there has been no available automated device that has a selling price low enough to make it readily available to the pickup player.

Various ways have been devised to mitigate and/or obviate the afore-described scoring difficulties of the conventional table tennis games scoring methods have arisen and been patented. For example:

U.S. Pat. No. 5,566,936 to Newgarden et al., generally describes an "ELECTRONIC TABLE TENNIS GAME" that is an electronically monitored single-player version of table tennis in which the single player returns a mechanically served ball and is able to score by striking one or more targets "strategically placed on the table surface."

U.S. Pat. No. 6,200,236 to Minami et al., describes a "TABLE TENNIS APPARATUS" having a "ball projecting section" disposed rearward of one playing surface of a table for projecting balls towards the other playing surface; a moving mechanism for allowing ball projecting section to be moved laterally, a detecting unit for detecting which side the balls have dropped on one playing surface in the lateral direction, and a driving and controlling unit for driving the moving mechanism according to the drop positions of the detected balls, and for moving the ball projecting section towards the drop positions of the balls. The moving mechanism includes a guide rail disposed along a lateral direction, and a base having the ball projecting section mounted thereon, and slidably disposed on the guide rail.

U.S. Pat. No. 6,270,431 to Martin, "CONTROL GRID FOR TABLE TENNIS SCOREKEEPING DEVICE WITH AUDIO AND VISUAL DISPLAY," generally discloses a control grid for an automated scorekeeping device for table tennis or ping pong. The invention includes a voice recorder that is used to announce the score before each serve of the apparatus, and further includes optional visual displays of scores. The scorekeeping device is actuated by means of a grid system of sensors attached to the ends of the table. The grid is activated by the players' touching the grid with a conductive strip affixed to the end of their paddles. It can be used in multiple modes.

SUMMARY OF THE INVENTION

According to the present invention, there is disclosed an electronic table tennis system comprising a table adapted for playing table tennis having a rectangular surface and a net disposed across the surface midway between the opposite ends of the rectangular surface. The tennis system also includes an electronic scoreboard, a plurality of touch sensors disposed on the rectangular surface for directing sensor signals to the scoreboard, and a plurality of laser scanner/locators for creating a locator field to identify the location of the ball and directing location signals to the scoreboard. The electronic apparatus also includes a table tennis ball having an identifying code imprinted upon its surface. The aforesaid plurality of touch sensors are disposed at each corner of the rectangular surface. The electronic scoreboard integrates the sensor signals from the touch sensors and the location signals from the laser scanner/locators for calculating a score and has a computer to integrate the sensor signals and the location signals for calculating a score displaying the score. The electronic scoreboard can be connected to an alerting system to notify of score changes, and the alerting system includes light and sound displays. The identifying code on the table tennis ball is imprinted at multiple locations upon the surface of the ball, and the identifying code is a bar code. The plurality of touch sensors incorporate solid-state microswitches, and the plurality of laser scanner/locators for creating a locator field comprise two laser scanner/locators that arc disposed adjacent to corners of the table whereby the locator field is flat and above the net.

Further according to the present invention, there is disclosed a method of playing an electronic table tennis game comprising the steps of providing a table tennis table having a rectangular surface and a net disposed across the surface midway between the opposite ends of the rectangular surface, providing a table tennis ball having an identifying code, providing an electronic scoreboard, creating a locator field with a plurality of laser scanner/locators to interact with the identifying code on the table tennis ball and determine the location of the ball with respect to the table, directing location signals corresponding to the location of the ball to the electronic scoreboard, and directing sensor signals to the electronic scoreboard from a plurality of touch sensors disposed on the rectangular surface to the electronic scoreboard when the ball contacts one of the plurality of touch sensors.

Yet further according to the present invention, the method includes the further step of disposing the plurality of touch sensors at each corner of the rectangular surface and integrating the sensor signals from the touch sensors and the location signals from the laser scanner/locators for calculating a score with the further step of displaying the score on the electronic scoreboard.

Still further according to the present invention, the method yet further includes the step of connecting an alerting system to the electronic scoreboard to notify of score changes and the step of displaying light and sound with the alerting system to notify of score changes.

Yet further according to the present invention, the method includes the steps of creating a locator field with two laser scanner/locators and the step of forming a flat locator field above the net by disposing the two laser scanner/locators adjacent to corners of the table.

DEFINITION

"Ping pong" is the same as "table tennis," and vice versa, i.e., said terms are synonymous.

BRIEF DESCRIPTION OF THE DRAWINGS

The structure, operation, and advantages of the present invention will become apparent upon consideration of the description herein below taken in conjunction with the accompanying figures. The figures are intended to be illustrative, not limiting. Certain elements in some of the figures may be omitted, or illustrated not-to-scale, for illustrative clarity.

Although the invention is generally described in the context of these preferred embodiments, it should be understood that the figures are not intended to limit the spirit and scope of the invention to these particular embodiments.

Figure 1:
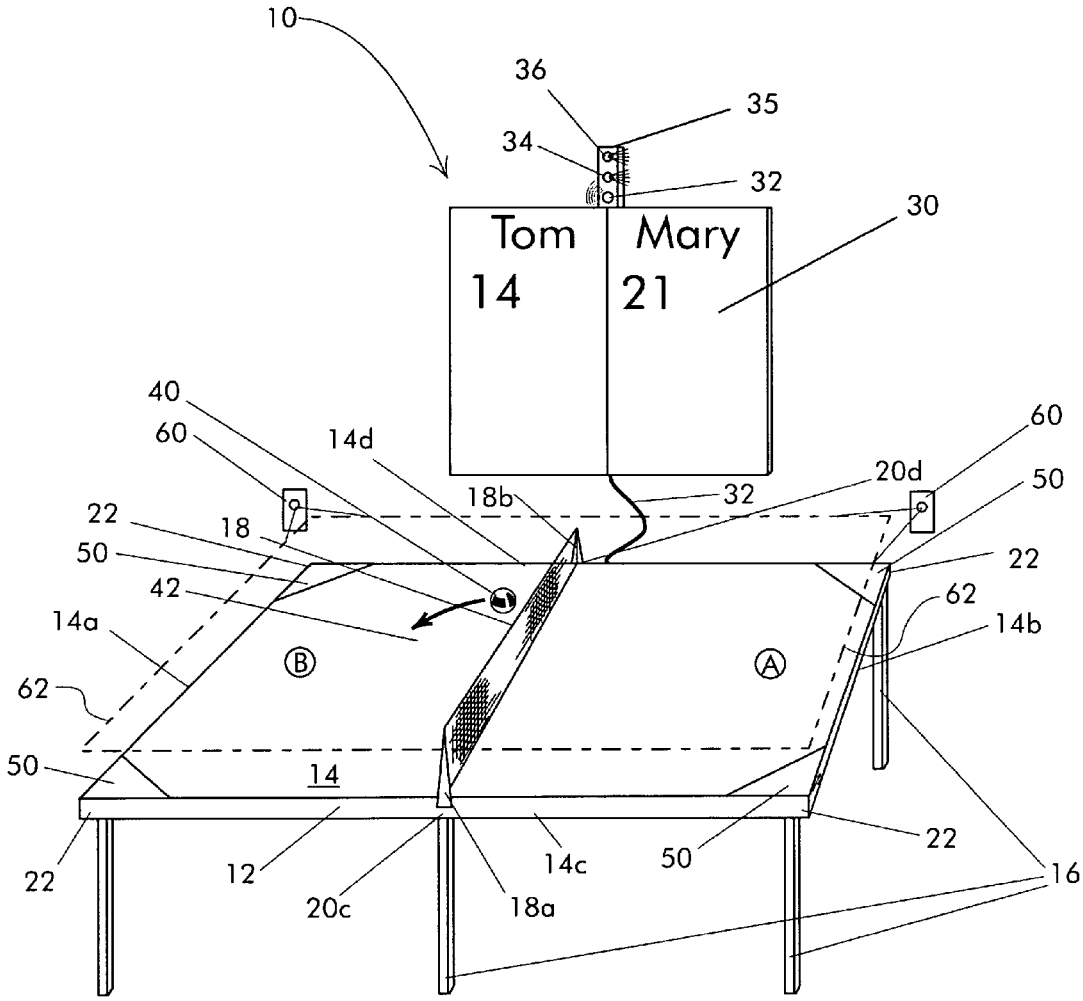
Figure 2:
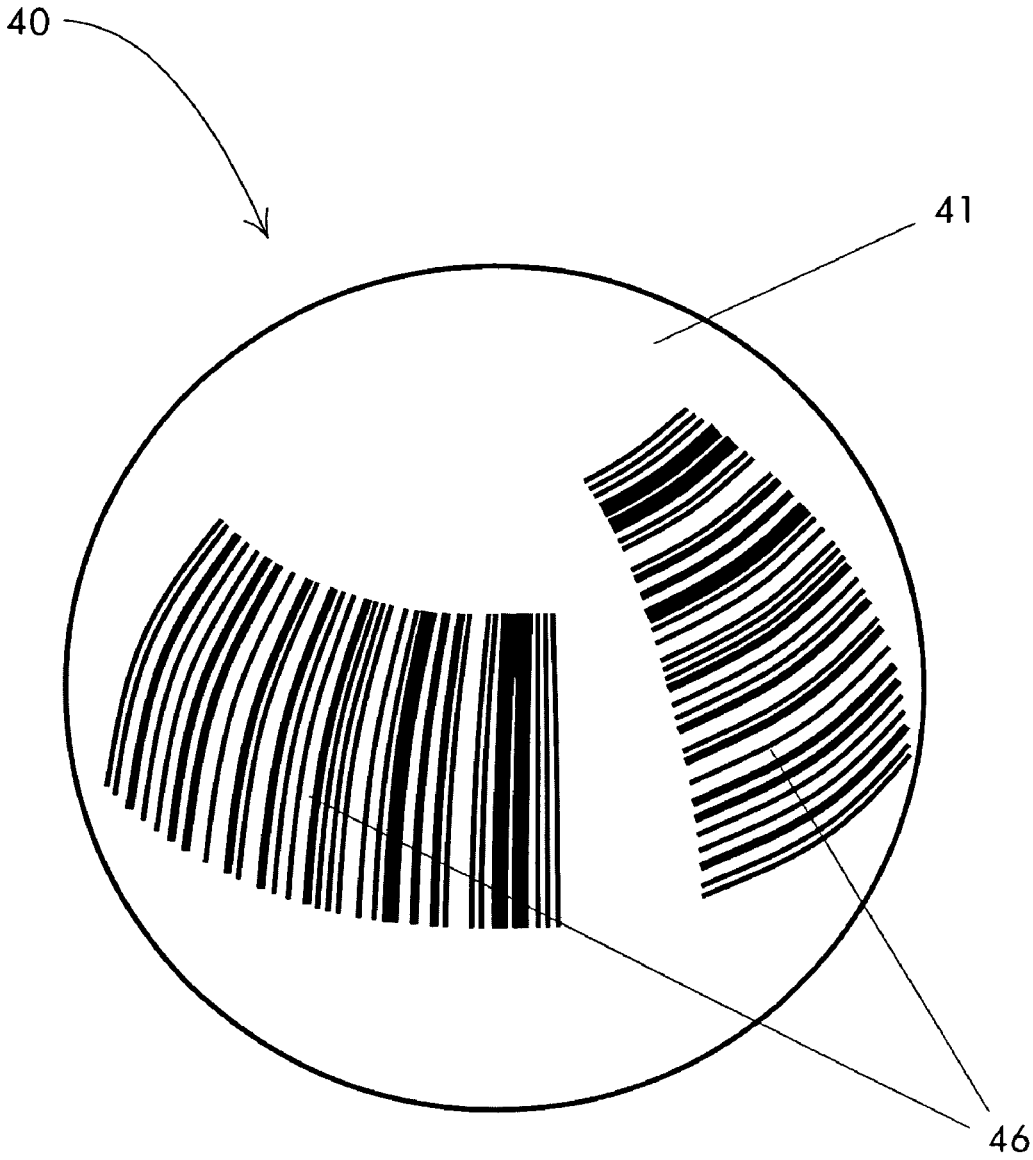

The structure, operation, and advantages of the present preferred embodiment of the invention will become further apparent upon consideration of the following description taken in conjunction with the accompanying figures, wherein:

FIG. 1 is a schematic oblique view of a regulation ping pong or table tennis table outfitted with elements of the present invention; and FIG. 2 shows an exemplary ping pong ball having multiple imprints of a bar code thereupon.

DETAILED DESCRIPTION OF THE INVENTION

As shown in FIGS. 1 and 2 an electronic table tennis apparatus 10 includes components that comprise a multi-part add-on or "attachment" feature that is affixed to, used with, and/or arranged in relation to a standard ping pong table 12. The ping pong table 12 comprises a horizontal rectangular flat surface 14 having four corners 22, disposed upon a plurality of legs 16 (four to six of them, which may be either rigidly or foldably attached to the horizontal surface portion surface 16), and a net 18 disposed across the middle of the narrow part of the table between sides 14*c*, 14*d* so as to be equidistant from, and parallel with respect to, the ends 14*a*, 14*b* of the table. That is to say, the net 18 is disposed across the surface midway between the opposite ends 14*a*, 14*b* of the rectangular surface. The net 18 is supported by two brackets 18*a*, 18*b* at the midpoints 20*c*,20*d* of the long sides 14*c*, 14*d* of the table 12. With two players, one stands at the end of table 12 corresponding to location A, adjacent the edge 14*b* of table 12, while the second player stands at the corresponding other end of the table, near location B, adjacent edge 14*a*.

The invention 10 includes a plurality of touch sensors 50 disposed at each corner of the rectangular surface of table 12 for directing sensor signals to an attached electronic scoreboard 30, which displays the score. The sensors are listed and described herein below. The electronic scoreboard portion 30 can include an alerting system 35 that includes light and sound displays or, more specifically, an audible bell or buzzer 32, a green warning light 34, and a red warning light 36 to notify of score changes. The scoreboard 30 also includes a computer (not shown) disposed internally such that, in effect, the electronic scoreboard integrates the sensor signals from the touch sensors and the location signals from the laser scanner/locators for calculating a score. The scoreboard 30 can be communicationally linked, such as a cable 32, to a multiplicity of sensors, which are individually described herein below, within and/or upon the surface 14 of the table 12. The invention 10 further includes a ping pong ball 40, shown by arrow 42 in aerial transit over the net 18. The ping pong ball 40 is shown in detail in FIG. 2. The invention 10 yet further includes touch sensors 50 disposed at each corner 22 upon the surface 14 of the table 12. Also, it is within the terms of the invention to use more or less sensors and to place them. While illustrated as triangular shaped, it is within the terms of the invention to use any desired shape, such as but exclusive, square or rectangular. The detectors are communicationally linked to one another and to the scoreboard portion 30.

It is within the terms of the present invention, that the touch sensors 50 employ the use of such standard sensor technologies as solid-state micro-switches, accelerometers, or micro-capacitive detectors.

Referring now to FIG. 2, the ping pong ball 40 is shown in detail. Imprinted in multiple locations upon the outer surface 41 of the table tennis ball 40 is an identifying code 46 which identifies that specific ball. The code is a bar code 46 and is imprinted at multiple locations, for example two as shown, upon the surface of the ball 40. The bar code 46 allows the keeping of an accurate score as to whose ball is in play.

Referring once again to FIG. 1, the invention 10 is seen to further includes a plurality of laser scanner/locator modules 60 so disposed as to create a "locator field" 62 (shown as an obliquely viewed rectangular broken line) to identify the location of the ball 40 and direct location signals to the scoreboard 30. The locator field 62 is disposed above the surface of the table 12 at an elevation that does not include the net 18. An oscillating beam of laser light from each scanner/locator module 60 detects the ball 40 as it passes through, noting its bar code 46 identifier and also determining its location with respect to the edges 14*a*, 14*b*, 14*c*, 14*d* of the table 12. The laser light from the scanners 60 can be visible light or infrared light. The locator field allows no interference with shot and no alteration of playing surface.

When the ball 40 passes through the scanner field 62, the scoreboard 30 records a point. The plurality of laser scanner/locators 60, for creating the locator field 62, can include two laser scanner/locators disposed adjacent to corners 22 of the table 12 whereby the locator field is flat and above the net. While two laser scanner/locators 60 are shown, it is within the terms of the present invention to use more laser scanner/locators 60 in various locations.

OPERATION OF THE INVENTION

According to the present invention, the ping pong table electronic system 10 can operate such that when the ball 40 is in play between two players located respectively at the A and B ends of the table 12, the locator field 62 notes the location at which the ball penetrates the field and notes the ball's bar code 46 identifier.

A missed play on the part of either player, or a play in which the ball flies abroad of the table 12 so as to be a bad shot can be detected in the following way by the locator field 62 and the computer in the scoreboard 30: If the ball 40 is served, or being returned, by the player at the B end of the table, and the player at the A end of the table misses the ball, then the missed play will be detected by the non-detection of the ball by the locator field within a specified period of say 1 second, give or take; likewise, if the player at the A end of the table does hit the ball but sends it wide of the B end of table, then the same non-detection feature of the sensor and computer software will record a point for the player located at the B end of the table.

Still further according to the present invention, the system 10 operates such that the triangular touch-sensors 50 at each corner 22 of the table 12 can and will detect the impact of the ball 40 within those portions of the table. For example, when one player knocks the ball 40 into one of the triangular corner regions, the detector 50 senses the impact of the ball and sends a signal to the scoreboard 30 which records three points for the player who hit the ball into that region. At the same time, the buzzer 32 can be engaged to emit an audible buzzer or bell signal, and the green light 34 will momentarily turn ON. The inventor considers the award of three points to a successful "corner shot" to be a way to reward superior play.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described alloy compositions, the terms (including a reference to a "means") used to describe such alloy compositions are intended to correspond, unless otherwise indicated, to any alloy composition which performs the specified function of the described alloy composition (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. An electronic table tennis apparatus comprising:

a table adapted for playing table tennis having a rectangular surface and a net disposed across the surface midway between the opposite ends of the rectangular surface;

an electronic scoreboard;

a plurality of touch sensors disposed on the rectangular surface for directing sensor signals to the scoreboard;

a table tennis ball having an identifying code imprinted upon its surface; and a plurality of laser scanner/locators for creating a locator field to identify the location of the ball and directing location signals to the scoreboard.

2. The electronic table tennis apparatus of claim 1 wherein the plurality of touch sensors are disposed at each corner of the rectangular surface.

3. The electronic table tennis apparatus of claim 1 wherein the electronic scoreboard integrates the sensor signals from the touch sensors and the location signals from the laser scanner/locators for calculating a score.

4. The electronic table tennis apparatus of claim 3 wherein the electronic scoreboard has a computer to integrate the sensor signals and the location signals for calculating a score.

5. The electronic table tennis apparatus of claim 4 wherein the electronic scoreboard displays the score.

6. The electronic table tennis apparatus of claim 5 wherein the electronic scoreboard is connected to an alerting system to notify of score changes.

7. The electronic table tennis apparatus of claim 6 wherein the alerting system includes light and sound displays.

8. The electronic table tennis apparatus of claim 1 wherein the identifying code on the table tennis ball is imprinted at multiple locations upon the surface of the ball.

9. The electronic table tennis apparatus of claim 8 wherein the identifying code is a bar code.

10. The electronic table tennis apparatus of claim 1 wherein the plurality of touch sensors incorporate solid-state microswitches.

11. The electronic table tennis apparatus of claim 1 wherein the plurality of laser scanner/locators for creating a locator field comprise two laser scanner/locators.

12. The electronic table tennis apparatus of claim 11 wherein the two laser scanner/locators are disposed adjacent to corners of the table whereby the locator field is flat and above the net.

13. A method of playing an electronic table tennis game comprising the steps of:

providing a table having a rectangular surface and a net disposed across the surface midway between the opposite ends of the rectangular surface;

providing a table tennis ball having an identifying code;

providing an electronic scoreboard;

creating a locator field with a plurality of laser scanner/locators to interact with the identifying code on the table tennis ball and determine the location of the ball with respect to the table;

directing location signals corresponding to the location of the ball to the electronic scoreboard; and directing sensor signals to the electronic scoreboard from a plurality of touch sensors disposed on the rectangular surface to the electronic scoreboard when the ball contacts one of the plurality of touch sensors.

14. The method of claim 13 including the step of:

disposing the plurality of touch sensors at each corner of the rectangular surface.

15. The method of claim 14 including the step of integrating the sensor signals from the touch sensors and the location signals from the laser scanner/locators for calculating a score.

16. The method of claim 15 including the step of displaying the score on the electronic scoreboard.

17. The method of claim 16 including the step of connecting an alerting system to the electronic scoreboard to notify of score changes.

18. The method of claim 17 including the step of displaying light and sound with the alerting system to notify of score changes.

19. The method of claim 13 including the step of creating a locator field with two laser scanner/locators.

20. The method of claim 19 including the step of forming a flat locator field above the net by disposing the two laser scanner/locators adjacent to corners of the table.

* * * * *